US011056829B2

(12) United States Patent
Weirback et al.

(10) Patent No.: US 11,056,829 B2
(45) Date of Patent: Jul. 6, 2021

(54) ELECTRICAL CONNECTOR ASSEMBLY WITH UNLOCKING DEVICE FOR THE UNLOCKING PROCESS

(71) Applicant: HUBER+SUHNER AG, Herisau (CH)

(72) Inventors: Andrew Weirback, Ringoes, NJ (US); Maddiel Gonzalez, West New York, NJ (US)

(73) Assignee: HUBER+SUHNER AG, Herisau (CH)

( * ) Notice: Subject to any disclaimer, the term of this patent is extended or adjusted under 35 U.S.C. 154(b) by 0 days.

(21) Appl. No.: 16/481,201

(22) PCT Filed: Dec. 1, 2017

(86) PCT No.: PCT/EP2017/081133

§ 371 (c)(1),
(2) Date: Jul. 26, 2019

(87) PCT Pub. No.: WO2018/145791

PCT Pub. Date: Aug. 16, 2018

(65) Prior Publication Data

US 2020/0006892 A1 Jan. 2, 2020

Related U.S. Application Data

(60) Provisional application No. 62/456,389, filed on Feb. 8, 2017.

(51) Int. Cl.
*H01R 13/422* (2006.01)
*H01R 13/627* (2006.01)
(Continued)

(52) U.S. Cl.
CPC ..... *H01R 13/6277* (2013.01); *H01R 13/422* (2013.01); *H01R 13/6585* (2013.01); *H01R 24/40* (2013.01)

(58) Field of Classification Search
CPC ..... H01R 13/6585; H01R 13/6277; H01R 13/422
See application file for complete search history.

(56) References Cited

U.S. PATENT DOCUMENTS 4,531,805 A * 7/1985 Werth ..... H01R 9/032 439/607.27
5,276,752 A * 1/1994 Gugelmeyer ..... H01R 13/6277 385/55
(Continued)

FOREIGN PATENT DOCUMENTS

CN 104466610 A 3/2015
EP 1 107 377 A1 6/2001
(Continued)

OTHER PUBLICATIONS

Chinese Patent Office, English language version of the First Notification of Office Action for Chinese Application No. 201780084330.5, dated Apr. 13, 2020 (12 pages).
(Continued)

*Primary Examiner* — Tho D Ta
(74) *Attorney, Agent, or Firm* — Pauley Erickson & Swanson

(57) ABSTRACT

An electrical connector assembly includes a first connector portion with a first housing with a circumferential inner locking shoulder at a first end of the first housing and a second connector portion interconnectable with the first connector portion, having a second housing with a circumferential outer groove arranged coaxially with respect to a connector axis. A radially deformable locking ring is arranged in the circumferential groove of the second connector portion. The locking ring includes a circumferential outer locking shoulder, behind which the inner locking shoulder of the first connector portion is locked in a connected state of the first and the second connector portion and
(Continued)

an unlocking surface that is circumferentially accessible from the outer vicinity in the connected state.

14 Claims, 6 Drawing Sheets

(51) Int. Cl.
*H01R 13/6585* (2011.01)
*H01R 24/40* (2011.01)

(56) References Cited

U.S. PATENT DOCUMENTS

| | | | | |
|---|---|---|---|---|
| 5,938,465 | A | 8/1999 | Fox, Sr. | |
| 6,290,525 | B1 * | 9/2001 | Jacobi | H01R 13/6277 439/310 |
| 6,645,011 | B2 | 11/2003 | Schneider et al. | |
| 7,252,533 | B1 * | 8/2007 | Lee | H01R 13/6273 439/382 |
| 8,944,838 | B2 * | 2/2015 | Mulfinger | G02B 6/3893 439/352 |
| 9,246,273 | B2 | 1/2016 | Montet et al. | |
| 2011/0309823 | A1 | 12/2011 | Palassis et al. | |
| 2013/0109210 | A1 | 5/2013 | Zhang | |
| 2016/0204557 | A1 * | 7/2016 | Kim | H01R 13/6277 439/578 |

FOREIGN PATENT DOCUMENTS

| | | | | |
|---|---|---|---|---|
| GB | 2 139 018 | A | 10/1984 | |
| GB | 2475089 | A | 5/2011 | |
| WO | WO 2008/051741 | A2 | 5/2008 | |
| WO | WO-2015063152 | A1 * | 5/2015 | H01R 9/0524 |

OTHER PUBLICATIONS

European Patent Office, English language version of the International Search Report, Form PCT/ISA/210 for Int'l Appln PCT/EP2017/081133, dated Feb. 13, 2018 (3 pages).

European Pateent Office, English language version of a European Office Action for European Application No. 17821805.3 (EPO forms 2001 and 2906), dated Feb. 22, 2021 (8pp.).

* cited by examiner

ELECTRICAL CONNECTOR ASSEMBLY WITH UNLOCKING DEVICE FOR THE UNLOCKING PROCESS

BACKGROUND OF THE INVENTION

Field of the Invention

The present invention relates to an electrical connector assembly and an unlocking device for unlocking said connector assembly, as well as to an unlocking method.

Discussion of Related Art

Electrical connectors with quick-locking functions such as snap fasting mechanisms are known from the prior art. One example of such a connector is the coaxial connector of the same assignee of the U.S. Pat. No. 6,645,011, published on the Nov. 11, 2003, comprising two complementary connector elements. A first one of the connector elements has a retaining member suitable for exerting a radial force on the second connector element which is arranged in such a manner that said radial force generates an axial force on the second connector element tending to press it axially against a bearing surface of the first connector element. Furthermore, the body of one of the connector elements has a member inserted therein that forms an internal ground contact and that is suitable for coming into contact with an inner wall of the body of the other connector element while exerting relatively strong contact pressure thereagainst. For unlocking purposes, these connectors generally feature an unlocking element, such as e.g. a ring, which serves to unlock the two connector elements from each other. The additional unlocking element is needed due to the very high locking/unlocking forces of the two connector elements. This unlocking element however has the disadvantage that it requires additional space. Consequently the connectors are thicker and/or longer and/or heavier than they would be without the unlocking element. Consequently the connector dimensions as well as the packing density are adversely affected.

It is an object of the invention to overcome at least one of the disadvantages of the know solutions of electrical connector fully or partly.

SUMMARY OF THE INVENTION

A connector assembly according to the invention comprises a first connector portion having a first housing with a circumferential inner locking shoulder at a first end of the first housing and a second connector portion interconnectable with the first connector portion, having a second housing with a first end and with a circumferential outer groove arranged coaxially with respect to a connector axis. In the circumferential outer groove a radially deformable locking ring can be arranged, which comprises a circumferential outer locking shoulder and an unlocking surface. The inner locking shoulder of the first connector portion is locked in a connected state of the first and the second connector portion behind the circumferential outer locking shoulder, thereby securing the two connector portions together and preventing axial disengagement of the first and second connector portion. The first and the second connector portion are being connected with the respective first ends of the first and the second housing facing each other. The circumferential inner locking shoulder is hereby referring to a diameter change of the first housing so that a thicker rim a formed at the first end of the first housing. Respectively, the circumferential outer locking shoulder is referring to a change of diameter of the locking ring so that a thicker rim is formed at the axial end of the locking ring facing in direction of connection.

A connector assembly in accordance with the present invention is particularly suited for applications in the millimeter-wave range, especially under adverse conditions such as vibrations and high temperatures.

The unlocking surface is circumferentially accessible from the outer vicinity in the connected state. Preferably, the locking ring is deformed by radial unlocking forces that are introduced on the unlocking surface. This concept according to the invention may be used preferably for coaxial connector assemblies with the connector assembly being essentially axially symmetrical to the connector axis. Space saving designs may be achieved, if the first connector portion is a female connector portion and the second connector portion is a corresponding male connector portion as a counter-element. The unlocking surface and the circumferential outer locking shoulder are axially arranged with an axial offset, respectively area, behind each other.

The connector assembly is an electric connector assembly, in particular a double-pole connector assembly. The connector assembly may in particular be a coaxial connector assembly, such as a high-frequency connector assembly. The coaxial connector assembly is than comprising a first connector portion having a first inner conductor and a first outer conductor and a second connector portion having a second inner conductor and a second outer conductor, all in coaxial arrangement around the connector axis.

For the locking of the first and the second connector portion, an engagement of the inner and the outer locking shoulder is generated by a radial interference, such as e.g. an radial overlap, of said inner and the outer locking shoulder. The radial interference, respectively overlap, hence needs to be cancelled for unlocking. This may be achieved if the radial overlap of the inner and the outer locking shoulder is smaller than the radial displacement of the outer locking shoulder caused by the deformation of the locking ring to disconnect the two connector portions. Hence, the (outer) diameter of the outer locking shoulder of the locking ring is typically greater than the (inner) diameter of the inner locking shoulder in the fully disconnected as well as in the fully connected state. However, the diameters of the locking ring in the fully disconnected state and in the connected state may not be the same, since the locking ring in a connected state may also be slightly pre-stressed and therefore radially deformed towards the connector axis in the connected state.

The deformation of the locking ring is preferably an elastic deformation and occurs as a change in shape or geometry upon a radial force being applied and is a radial deformation with no or no substantial axial deformation. The deformation of the locking ring is favorably not caused by a material compression. The locking ring is favorably made from an elastically deformable but substantially uncompressible material, in particular metal. Favorably, the deformation of the locking ring occurs in a limited deformation zone only and involves an elastic shear between an inner and outer surface of the locking ring. In a preferred embodiment, the locking ring is designed as a spring and may e. g. have a c-like shape. It may be designed as cylindrical tubular geometry with an axial slot that is through-going in the radial direction, such that the ring is not circumferentially closed but has a gap that is given by axial slot and the locking ring has first and a second end in circumferential direction. The axial slot favorably extends over both the outer locking shoulder and the unlocking surface. Therefore, the term "ring" in "locking ring" is not limited to circumferentially closed or through-going geometries. If such a c-shaped locking ring is radially deformed towards its center axis (corresponding to the connector axis), the axial slot becomes smaller and the first end, the second end advance each other and the diameter is accordingly reduced. Elastic deformation occurs in a deformation zone that is radially opposed to the slot, with the inner side of the ring being contracted and the other side being expanded. Hence, the outer locking shoulder is displaced in radial direction towards the connector axis. This c-shape has the advantage, that good results for the radial deformation can be achieved, meanwhile the locking ring is close to non-deformable in axial direction. Typically, the deformation shall be reversible as in that the locking ring takes back an original non-deformed shape, if no forces are applied.

Advantageously, the outer locking shoulder is further located in respect to the direction of connection behind to the unlocking surface on the locking ring. Furthermore, it is advantageous to place the unlocking surface adjacent and/or in close proximity to the outer locking shoulder. In that way, the unlocking forces applied on the unlocking surface are close to the outer locking shoulder. This is advantageous to avoid unwanted deformation such that the locking ring has a conus-like shape so the locking ring is deformed inwards in the region of the unlocking surface and outwards in the region of the outer locking shoulder; hence enhancing the engagement of the inner and outer locking shoulders.

To enhance the locking strength it may be advantageous, to locate a sloped surface or wedge in the circumferential outer groove of the second housing such that if the first and the second connector portion are exposed to an axial force, pulling the two connector portions in opposite directions while being interconnected, the sloped surface, respectively the wedge, interacts with the locking ring and pushes the latter radially outwards. By doing so, the radial overlap of the inner and the outer locking shoulder is increased and the locking forces are enhanced leading to a stronger interconnection of the two connector parts.

For establishment of a circumferential electrical contact between first end first housing and first end second housing resilient latches (finger) may be present, and/or other methods to establish contact can be used. Connectors with latches (fingers) are known, e.g. from the area of SMP and SMPM connector interfaces. The latches may be interconnected at a first end of the second housing and latch behind a circumferential contact shoulder of the first housing in the fully connected state. The resilient latches define the second outer conductor of the second connector portion and the circumferential contact shoulder defines the first outer conductor of the first connector portion. Preferably, the circumferential contact shoulder is then placed at an inner surface of the first housing. In the case of a coaxial connector, the latches may enhance the electrical contact meanwhile the interconnection via the locking ring may be preferably used to establish a sufficient and reliable mechanical connection of the two connector portions. Favorably, the electrical contact extends along the total or substantially the total circumference of the first and second housing, i. e. is close to 360°.

Hence, the contact forces of the latches may be designed much smaller than locking/unlocking forces of the locking ring. Furthermore, this at least partly functional division allows some amount of radial clearance between the locking ring and the second housing, without aversively affecting the electric contact. This radial clearance may be needed when radially deforming the locking ring during the unlocking of the two connector portions.

In case of a coaxial connector assembly, where the first and the second housing correspond to a first and a second outer conductor, it may be advantageous to use an additional isolation element which prohibits, respectively minimizes, the electrical contact of the locking ring and the second housing and/or restricts the electrical contact between the first and the second housing (first and second outer conductor) to a thereto designated contact area. Generally, if the connector assembly is subject to radial deflection or tilting (traverse to the connector axis) and no isolating element is present, this may lead to an undesired electrical contact in addition or instead of the thereto designated contact area (e.g. the latches) in any other area, in particular the contact area of the locking ring and the second housing. This partly or full electrical contact shift from the thereto designated contact area to the locking ring is hence prohibited by the isolating element. Thereby, the connector becomes electrically reliable and robust to maintain signal integrity under such conditions. The isolating element is placed advantageously radially between the locking ring and the second housing at the bottom of the outer groove and/or is at least partially encompassing the edge of the outer groove in such a way, that an electrical contact between the first and the second housing, respectively the outer conductors, is restricted to the therefore designated locations. The isolation element may comprise a single or multiple parts. Furthermore, the isolating element may further have a wedge such that if the first and the second connector portion are exposed to an axial force pulling the two connector portions in opposite directions while being interconnected, the wedge interacts with the locking ring and pushes the latter radially outwards. By doing so, the radial overlap of the inner and the outer locking shoulder is increased and the locking forces are enhanced leading to a stronger interconnection of the two connector parts.

For locking the connector assembly, the two connector portions are axially displaced towards each other until the inner locking shoulder comes into contact with the locking ring. In this state, the two connector portion are not yet in the fully connected state. The contact with the locking ring is preferably made over two circumferential locking surfaces; a first locking surface on the first housing and a second locking surface of the locking ring. As a results of this interaction between the two locking surfaces, the axial locking forces are redirected and the locking ring is radially deformed inwards towards the connector axis. After the inner and the outer locking shoulder have passed each other in direction of the connector axis, the inner and the outer shoulder interlock and fully connect the two connector portions. Depending on the connector design, the locking ring may or may not return into the initial, non-deformed and non-tensioned shape, as in the fully disconnected state. In some embodiments, the locking ring may only return partially towards the non-tensioned shape but remain somewhat compressed, thereby establishing a radial biasing force onto the inner locking shoulder.

Furthermore, the locking ring may have a signaling surface covered entirely by the inner locking shoulder in the connected state. Hence, after an unsuccessful attempt of locking the signaling surface is still visible. This optically indicates the user that the locking process is not yet successfully completed.

For unlocking the connector assembly a method comprising the following steps may be used: In a first step, the locking ring may be deformed radially inwards. Preferably, this is done by initiating a radial force uniformly over the circumference of the locking ring in the region of the unlocking surface. The radial deformation should advantageously be in such a way, that the inner locking shoulder is completely disengaged from outer locking shoulder, respectively that the (outer) diameter of the outer locking shoulder is smaller than the (inner) diameter of the inner locking shoulder. The deforming of the unlocking ring can thereby be described by a reduction of the diameter of the unlocking ring as described above. In a subsequent second step, the first connector portion and the second connector portion can be disengaged by a relative displacement away from each other along the connector axis. After the releasing of the locking ring, said locking ring may than return into its non-deformed state by way of elastic return forces. In an embodiment, the locking ring is hereby deformed by an unlocking device as described hereinafter.

In a further embodiment, the connector assembly may comprise an Anti-EMI element (EMI: Anti-Electromagnetic Interference) which limits and favorably suppresses undesired interferences transmitted outward from the (inner) conductors in the presence of an electromagnetic field. In the connected state, the Anti-EMI element can be radially arranged between the first and the second housing.

In an embodiment, the interconnection of the first connector portion and the second connector portion may further be supported by two guiding surfaces that interact during the connection process, thereby avoiding an undesired tilting of one connector portion in relation to the other. The guiding surfaces may be arranged on the first and the second housing. However, also other solutions such as the presence of additional parts or element which feature at least one guiding surface may be provided; e.g. one guiding surface may be arranged on the Anti-EMI element and the other one on the first housing.

For unlocking of the connector assembly, an unlocking device may be used. The unlocking device preferably comprises at least one clamping element with a recess shaped to receive at least partly the second connector portion and a first rim extending in the recess, having a diameter smaller or equal than the diameter of inner locking shoulder. The unlocking tool may be designed as a pliers. In use, closing the pliers results in an inward-directed radial force being exerted onto the unlocking surface, thereby unlocking the connector assembly as explained before. Alternatively or addition to that, the unlocking device may further comprises a spreading element which helps to disengage the first and the second connector portion from the connected state by executing axial forces on the two connector portions pulling them apart. This may be achieved by e.g. designing the at least one clamping element with an additional wedge that is put between the first and the second connector portion and which is driven between the two connector portions during closing of the at least one clamping element. Alternatively, this may further be achieved by using a displaceable part on the unlocking device (as the spreading element) which encompasses at least partly and axially secures the first connector portion through a second rim engaging in a unlocking groove of the first connector portion. Preferably, the displaceable part may comprises an actuator by which a user may move the displaceable part in direction of the connector axis. The axial position of the displaceable part in relation to the unlocking device is preferably restricted in the direction of the connector axis. The displaceable part is displaceable between a first and a second position. This may e.g. achieved by means of a pin being part of the displaceable part, moving in a restricted cutaway of the non-displaceable parts of the unlocking device. In an initial first position, the first and the second connector portions are in the connected state; however, the locking ring is radially deformed by the first rim as described above. By displacing the displaceable part in direction of the connector axis into a second position, the first connector portion is moved away from the second connector portion through the engagement of the second rim with the unlocking groove. Therefore, during the displacement process the inner locking shoulder is moved over the outer locking shoulder. Hence, in the second position, the connector portions are in the fully disconnected state.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF SEVERAL VIEWS OF THE DRAWINGS

The herein described invention will be more fully understood from the detailed description given herein below and the accompanying drawings which should not be considered limiting to the invention described in the appended claims. The drawings are showing:

DETAILED DESCRIPTION OF THE INVENTION

Reference will now be made in detail to certain embodiments, examples of which are illustrated in the accompanying drawings, in which some, but not all features are shown. Indeed, embodiments disclosed herein may be embodied in many different forms and should not be understood as limited to the embodiments set forth herein; rather, these embodiments are provided so that this disclosure will satisfy applicable legal requirements. Whenever possible, like reference numbers will be used to refer to like components or parts.

Figure 1:
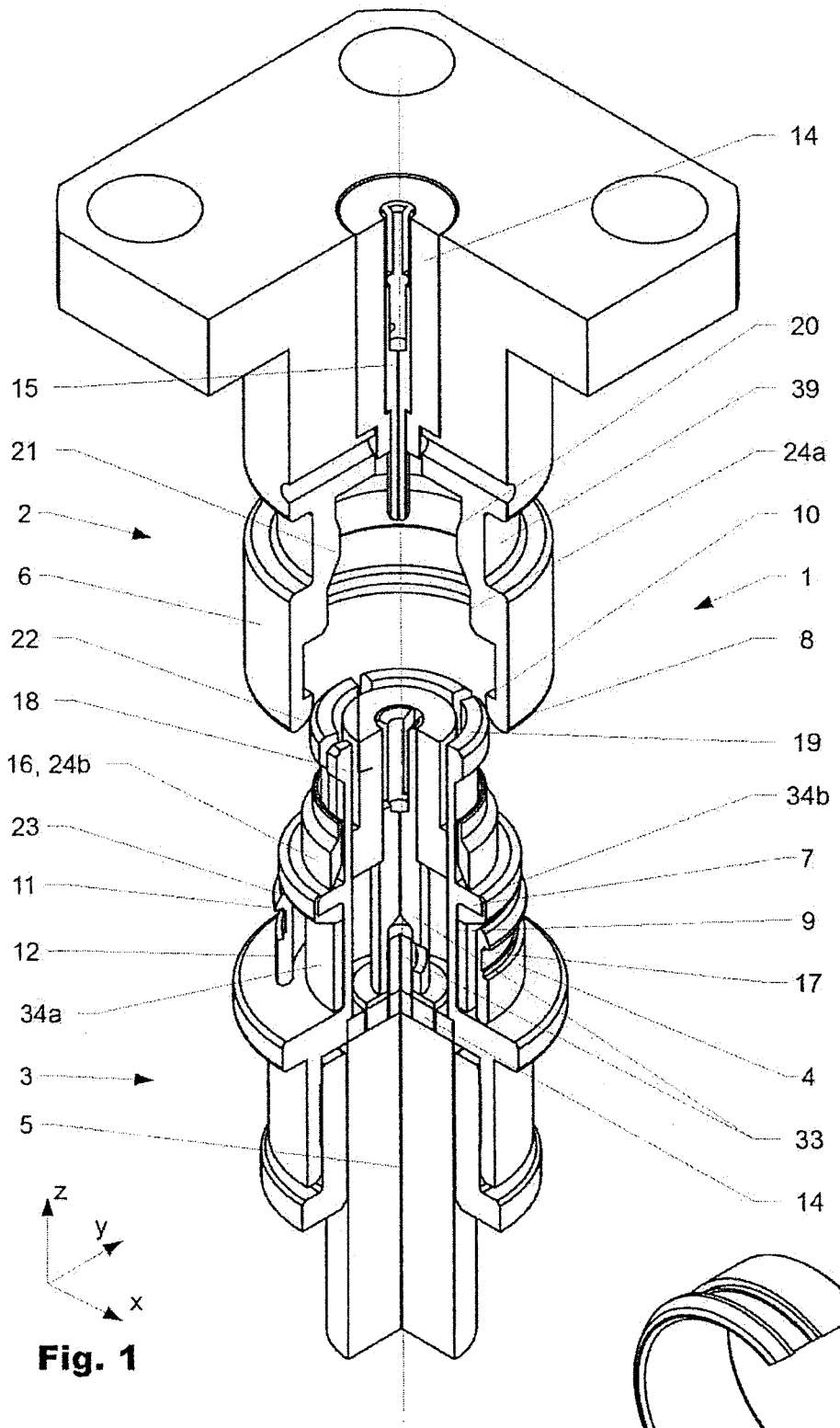
FIG. 1 is an embodiment of a connector assembly 1 according to the invention with the connector portions 2, 3 being apart in a perspective view, partly sectionized.
Figure 3:
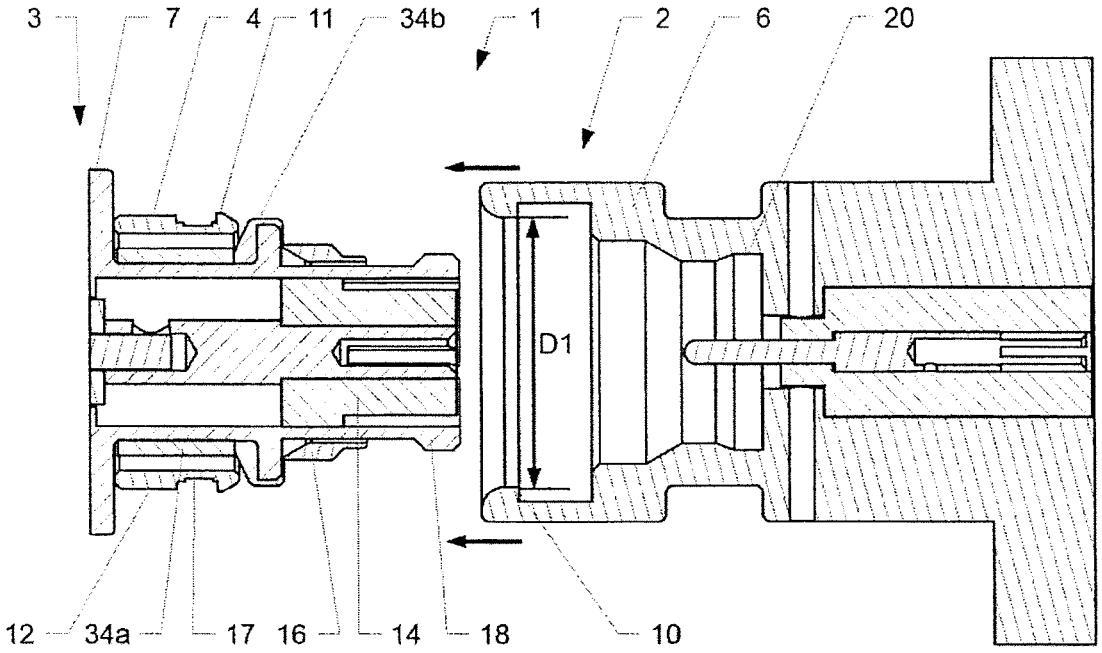
FIG. 3 is the connector assembly 1 according to FIG. 1 in a sectionized view with the connector portions 2, 3 being apart, about to be connected.
Figure 4:
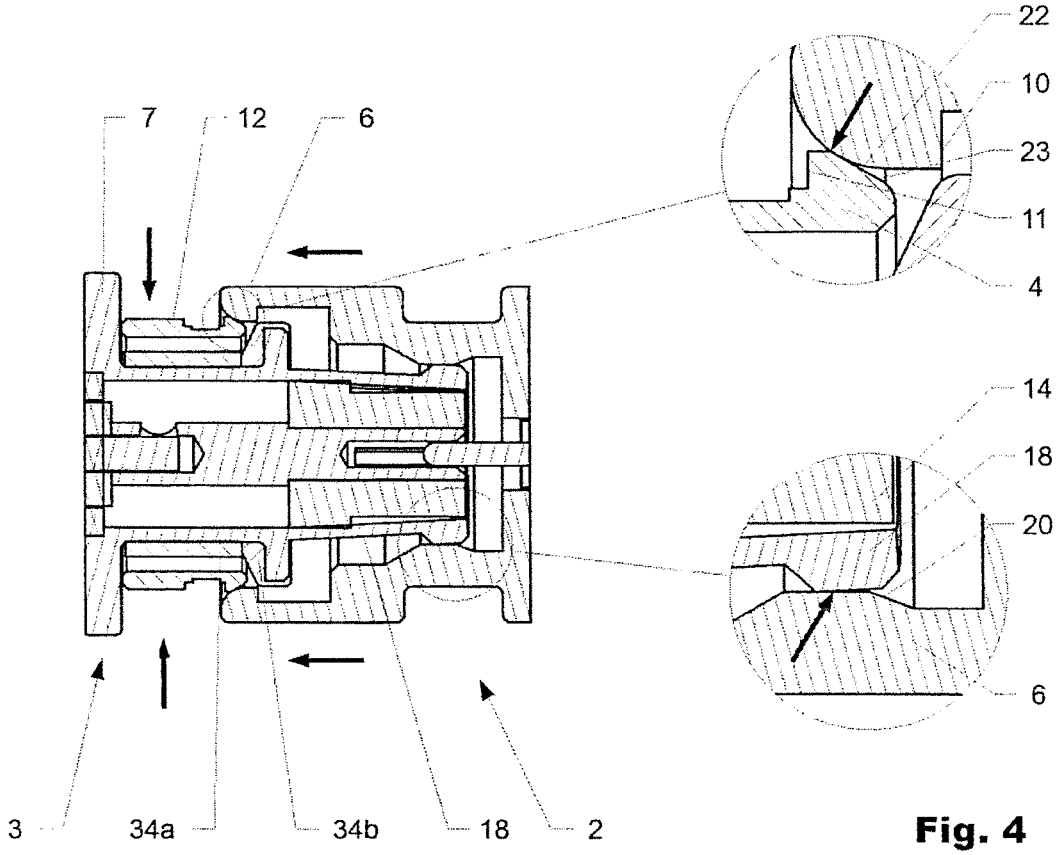
FIG. 4 is the connector assembly 1 according to FIG. 1 in a sectionized view with the connector portions 2, 3 about to be connected.

FIG. 1 shows a first embodiment of a connector assembly 1 according to the invention with a first and a second connector portions 2, 3 being unengaged and spaced along the connector axis. The connector assembly 1 is shown in a perspective view and partly sectionized for illustration purposes. FIG. 3 shows the same connector assembly 1 as illustrated in FIG. 1 comprising the first and the second connector portion 2, 3 which are illustrated apart, before being interconnected. In FIG. 4 the connector assembly 1 is illustrated in the process of interconnection and in FIG. 5 the first and the second connector portion 2, 3 are illustrated fully interconnected to each other, both in a sectionized view. The first connector portion 2, shown on the right hand side of the FIGS. 3-6, is comprising a first housing 6, an insulator 14 and a first inner conductor, resulting in a coaxial connector assembly. Therefore, the first housing 6 represents the first outer conductor in the shown variation. The second connector portion 3 comprises a second housing 7, respectively the second outer conductor, at least one insulator 14 and a second inner conductor 33 (consisting of multiple parts). A locking ring 4 is placed within an outer groove 9 of the second connector portion 3. Between the groove 9, respectively the second housing 7, and the locking ring 4, an isolating element (comprising multiple parts 34*a*, 34*b*) is present. The first part of the isolating element 34*a* is placed radially between the locking ring 4 and the second housing 7 at the bottom of the outer groove 9. The second part of the isolating element at least partially encompasses the edge of the outer groove 9 in such a way that an electrical contact between the second housing 7 and the first housing 6 is prohibited in the region where the locking takes place, such as the region of the first end 8 of the first housing 6. In the shown variation the second part of the isolating element 34*b* has further a wedge 41 such that, if the two connector portions are exposed to an axial force that pulls the two connector portions in opposite directions while being interconnected, the wedge 41 interacts with the locking ring 4 and pushes the latter radially outwards. By doing so, the radial overlap A1 (see FIG. 5) of the inner and the outer locking shoulder is increased and the locking forces are enhanced leading to a stronger interconnection of the two connector parts.

Figure 5:
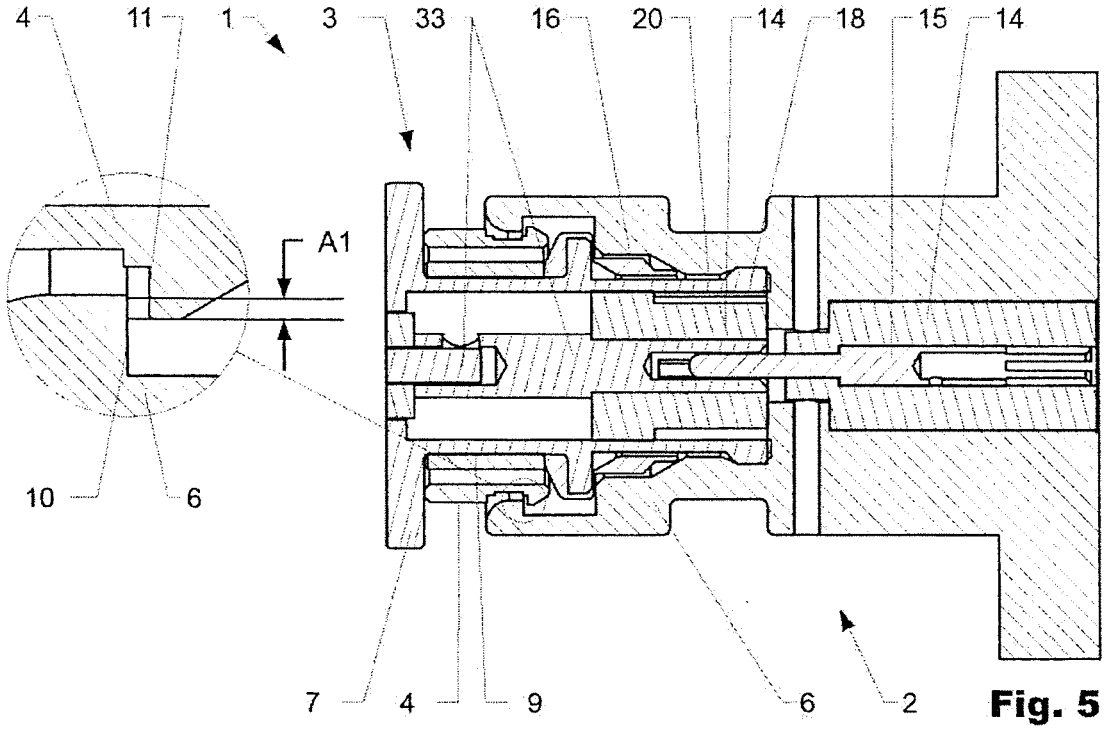
FIG. 5 is the connector assembly 1 according to FIG. 1 in a sectionized view with the connector portions 2, 3 connected.

The locking ring 4 has been snapped on the second housing 7, respectively on the isolating element, having axial as well as radial clearance and can preferably not be removed from the second housing 7 without special effort respectively without tools. On the outer side of the locking ring 4 an outer locking shoulder 11 is present, behind which an inner locking shoulder 10 of the first housing 6 is locked in a connected state of the first and the second connector portions 2, 3, as shown in FIG. 5. The second housing 7 further comprises multiple resilient latches 18 that are arranged at a first end 19 of the second housing 7. In the shown embodiment, the latches are an integral part of the second housing 7, however it is also possible to design the latches 18 as at least one separate part which is e.g. than interconnected to the second housing 7.

During the interconnection process as illustrated in FIGS. 3-5, the latches 18 are inserted in the first housing 6 where they latch behind an inner circumferential contact shoulder 20 (see e.g. detailed section in FIG. 4 on the bottom). This interconnection of the latches 18 and the first housing 6, respectively the first outer conductor, establishes the electrical path between the first and second outer conductor. When the first housing 6 is fitted on the second housing 7, the inner locking shoulder 10 is further snapped behind the outer locking shoulder 11 of the locking ring 4. This process is depicted in FIG. 4. The detailed section on the top hereby highlights the fact, that the first housing 6 comprises a first locking surface 22 that during locking interacts with a second locking surface 23 of the locking ring 4. As a results of this interaction, the forces are redirected and the locking ring 4 is deformed, as indicated by the arrows in FIG. 4. For this deformation to be possible, it is evident that the radial clearance of the locking ring allows this shown solution to be realizable. For an easy and user-friendly locking, the locking ring 4 may further comprise a signalling surface 17 which is covered entirely by the inner locking shoulder 10 in the connected state. Hence, if after an attempt of locking the signalling surface is still visible, this optically indicates the user that the locking process is not yet successfully completed. The signalling surface may optionally be clearly optically recognizable. For this purpose, it may for example be colored and/or have a different surface structure to optically distinguish from neighbouring elements.

The interconnection of the first connector portion 2 and the second connector portion 3 may further be supported by two guiding surfaces 24 which align the two connector portions 2, 3 and help to avoid an undesired tilting of one portion 2, 3 traverse to the connector axis 5. In the shown variation, the guiding surfaces 24 are present on the first housing 6 as well as on an Anti-EMI element 16. The Anti-EMI element 16 is part of the second connector portion 3 and is at least partly circumferentially encompasses the second housing 7 in the region of the on the latches 18. In the connected state of the two connector portion 2, 3 the Anti-EMI element 16 is radially arranged between the first and the second housing 6, 7, respectively between the first and the second outer conductor of the two connector portions 2, 3.

Figure 2:
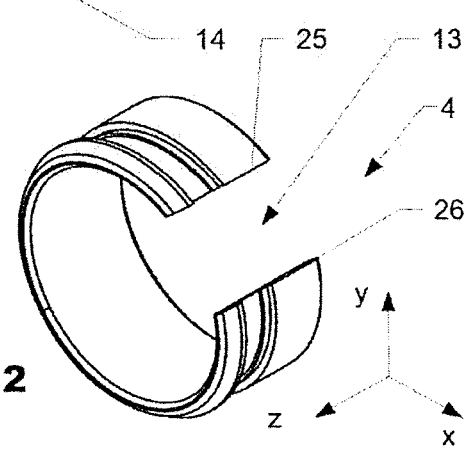
FIG. 2 is a variation of a locking ring 4 of the connector assembly 1 according to the invention in a perspective view.
Figure 6:
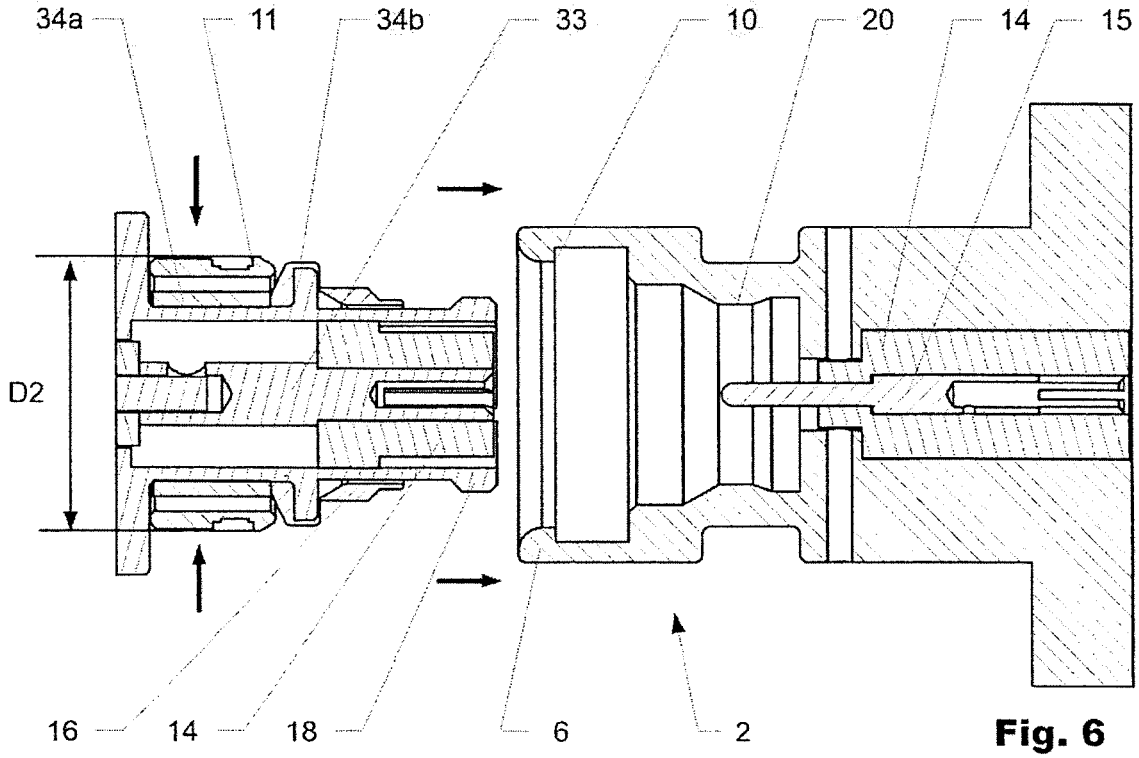
FIG. 6 is the connector assembly 1 according to FIG. 1 in a sectionized view with the connector portions 2, 3 being apart after disconnection.

For unlocking purposes, the outer and inner locking shoulders 10, 11 need to be disengaged and the two connector portions 2, 3 pulled apart along the longitudinal connector axis (compare FIG. 6). The contact forces of the latches are not as high as the locking forces of the locking ring, so that a user can typically pull the connector assembly apart by hand if the rocking ring is disengaged. To disengage the locking ring 4, the locking ring 4 may deformed inwards in a radial direction. For doing so, the locking ring 4 can feature an unlocking surface 12 that is circumferentially accessible from the outer vicinity in the connected state. By executing a radial force on the unlocking surface 12 of locking ring 4, the locking ring 4 is deformed in radial direction. Preferably, the radial overlap A1 (see FIG. 5) of the inner and the outer locking shoulder is smaller than the radial displacement (of the outer locking shoulder 11) caused by the deformation of the locking ring 4 to disconnect the two connector portions 2, 3. In other words, the outer diameter D2 of the outer locking shoulder 11 of the locking ring 4 is greater than the inner diameter D1 (see FIG. 5) of the inner locking shoulder 10 before as well as after locking. However, the diameters D2 of the locking ring 4 before and after locking do not necessarily have to be the same, since the locking ring 4 in a connected state may be slightly deformed, thereby exerting a radial biasing force. During the unlocking, the outer diameter D2 of the outer locking shoulder 11 is, resulting from the compression of the locking ring 4, smaller than the inner diameter D1 of the inner locking shoulder 10. The deformation properties of the locking ring 4 is preferably a result of the design of the shape of the locking ring 4 and not a material property such as the compressibility of a material, as described above. Such a shape deformation may e.g. be achieved by a locking ring that has one axial slot 13 that is continuous in the radial direction so that the locking 4 has a c-shape with a first end 25 and a second end 26, as illustrated in FIG. 2. If a locking ring 4 of this shape is radially deformed, the first end 25 and the second end 26 advance each other and the diameter D2 of the locking ring 4 becomes smaller. This shape has the advantage, that good results for the radial deformation can be achieved, meanwhile the locking ring 4 is close to non-deformable in axial direction (z-direction). In the shown variation, the outer locking shoulder 11 is located in respect to the direction of connection (positive z-direction) of the second connector portion 3 behind to the unlocking surface 12 on the locking ring 4. Furthermore is the unlocking surface 12 is adjacent and in close proximity to the outer locking shoulder 11.

Figure 7:
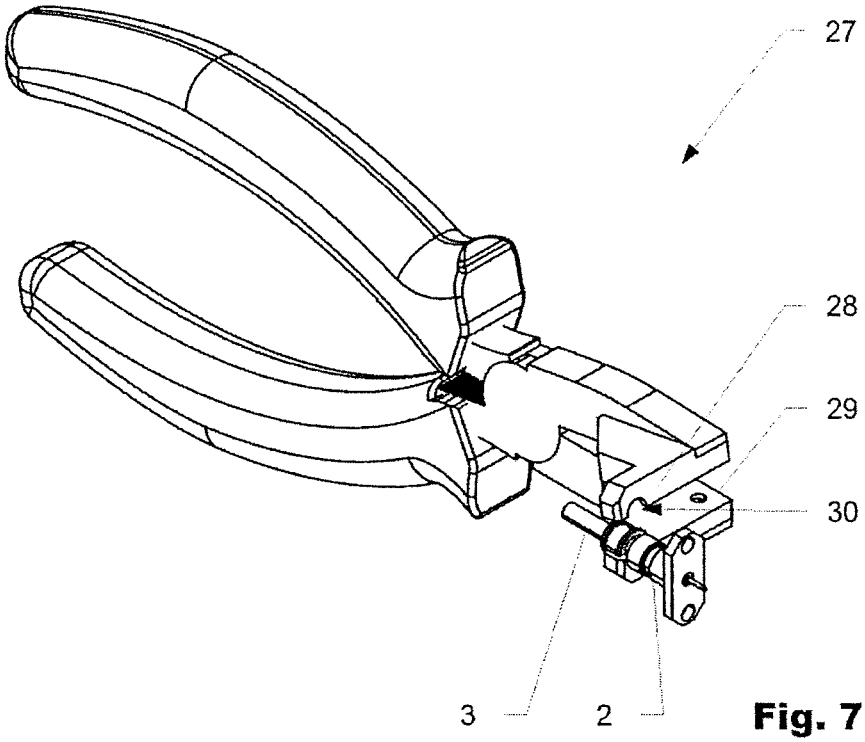
FIG. 7 is a first variation of an unlocking device 27 according to the invention.
Figure 8:
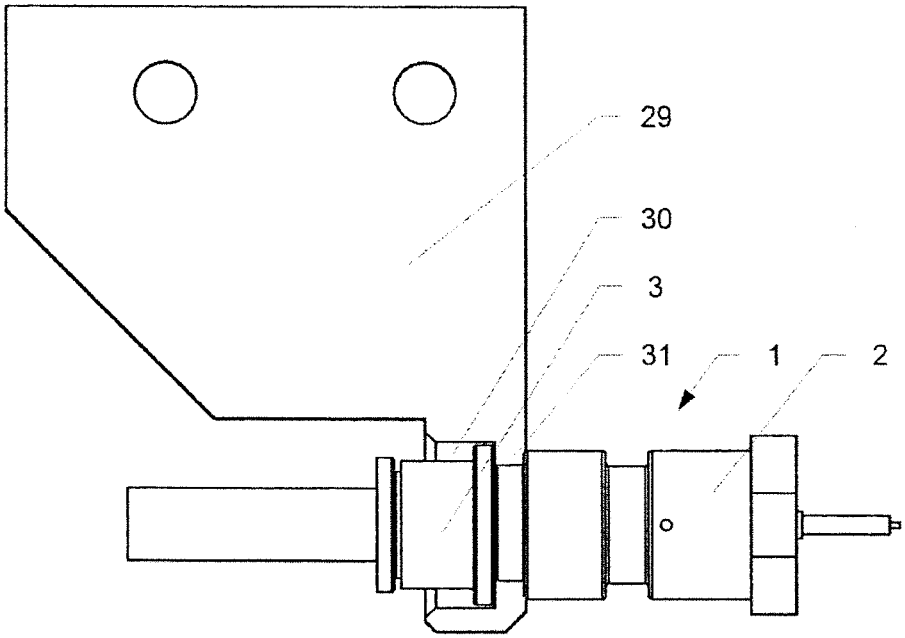
FIG. 8 is a detailed view from the top on a clamping element 28 of the unlocking device according to FIG. 7.
Figure 9:
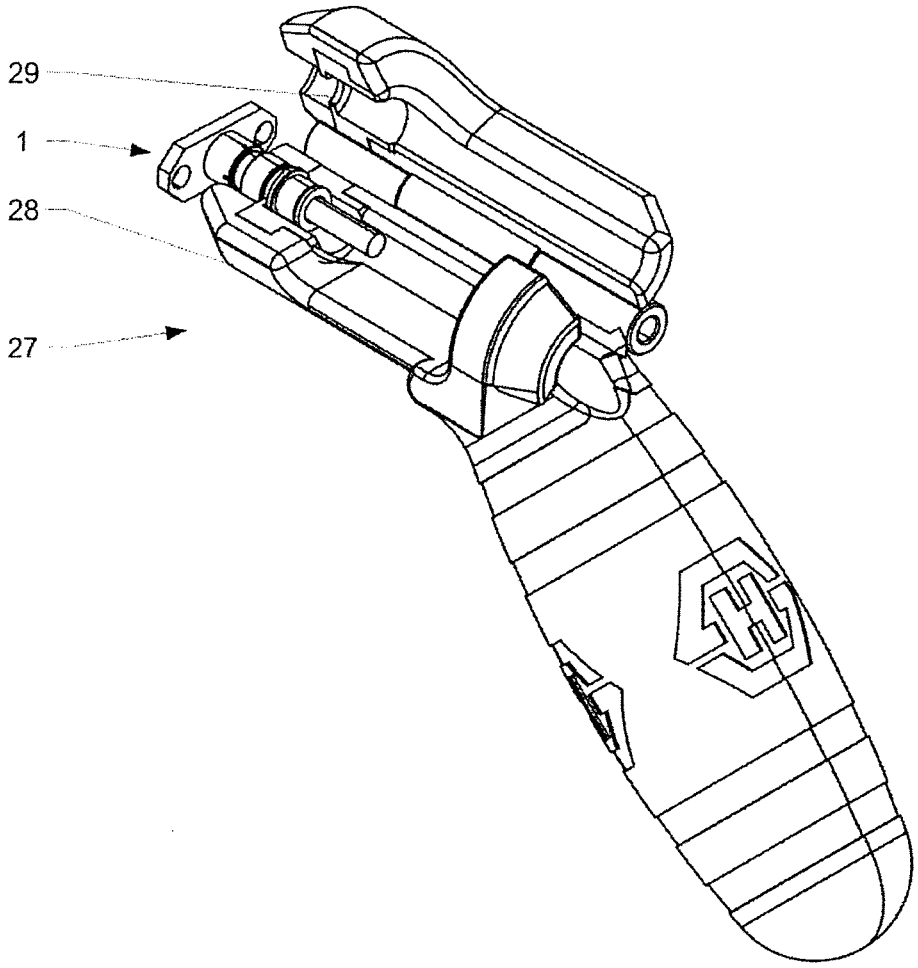
FIG. 9 is a second variation of an unlocking device 27 according to the invention.
Figure 10:
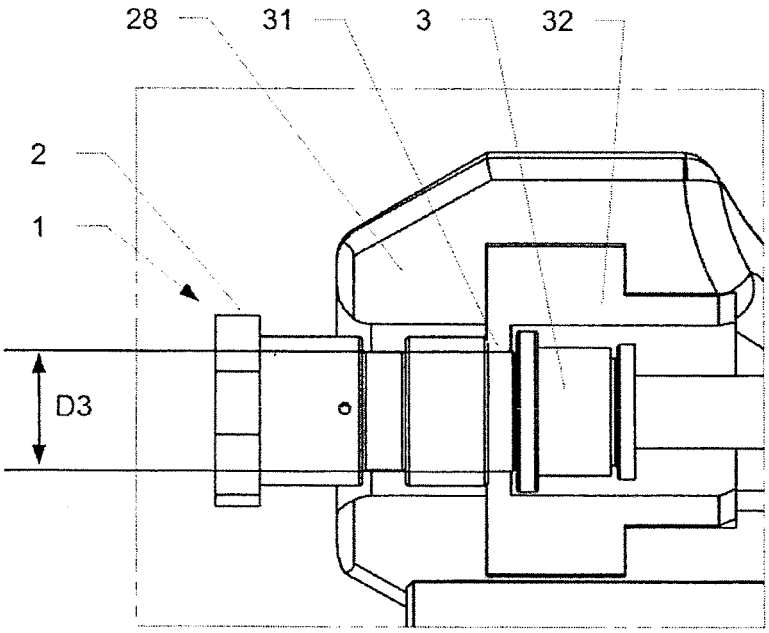
FIG. 10 is a detailed view from the top on a clamping element 29 of the unlocking device according to FIG. 9.

In order to deform the locking ring 4, an unlocking device 27 may be used. A first variation of the unlocking device 27 is shown in FIG. 7 and FIG. 8. A second variation of the unlocking device 27 is shown in FIG. 9 and FIG. 10, and a third variation is shown in FIG. 11 and FIG. 12.

All shown variations comprise two clamping elements 28, 29 with a recess 30 shaped to receive at least partly the connector assembly 1. In the shown variations, the two clamping elements 28, 29 are in an open position. In a closed position, the clamping elements 28, 29 are closed and circumventing and least partially the connector assembly 1. A first rim 31 is extending in the recess 30 in the region where the unlocking surface 12 is located. One clamping element 28 in an open position with the respective recess 30, receiving partly the connector assembly 1, is illustrated in more detail in FIG. 8 for the first variation of the unlocking device 27 in form of a pliers having two handles and in FIG. 10 for the second variation of the unlocking device 27. The first rim 31 has a diameter D3 smaller or equal than the diameter D1 of the inner locking shoulder 10. Therefore, if the two clamping elements 28, 29 are closed by means of pressing the handles of the pliers together, the locking ring 4 is radially deformed inwards by the first rim 31 of the unlocking device 27. This results is a disengagement of the outer and the inner locking shoulder 10, 11. After the disengagement the two connector portion 2, 3 can be pulled apart with a comparatively low amount of force needed, such as a user can use one hand to operate the unlocking device 27 and thereby fixating the second connector portion 3 and removing the first connector portion 2 with the other free hand. In both variations shown of the unlocking device 27, the clamping elements 28, 29 are designed so that they are exchangeable as to account for other connector sizes. In the second variation this exchangeability is achieved by the use of two inserts 32, which are part of the clamping elements 28, 29. In this variation, not the full clamping elements 28, 29 are being exchanged but only the inserts 32 of the unlocking device 27.

Figure 11:
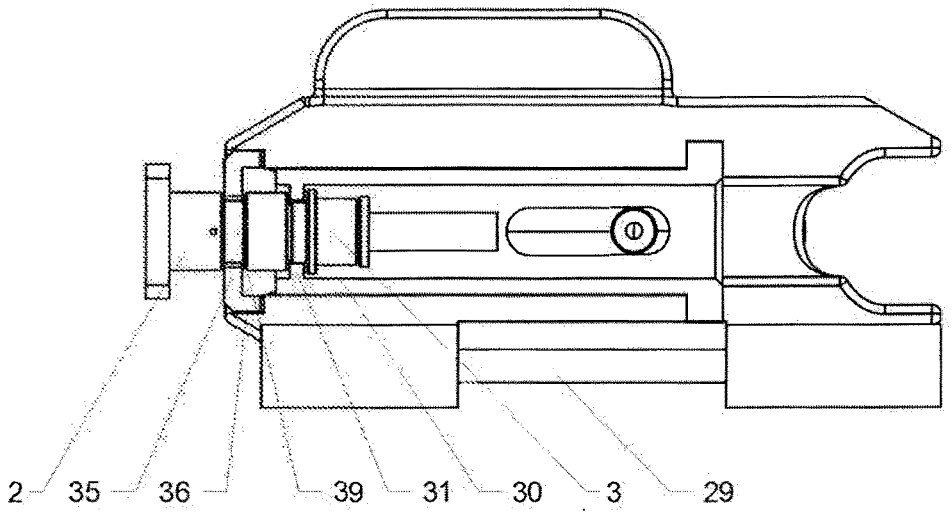
FIG. 11 is a third variation of an unlocking device 27 according to the invention in a first position of a displaceable part.
Figure 12:
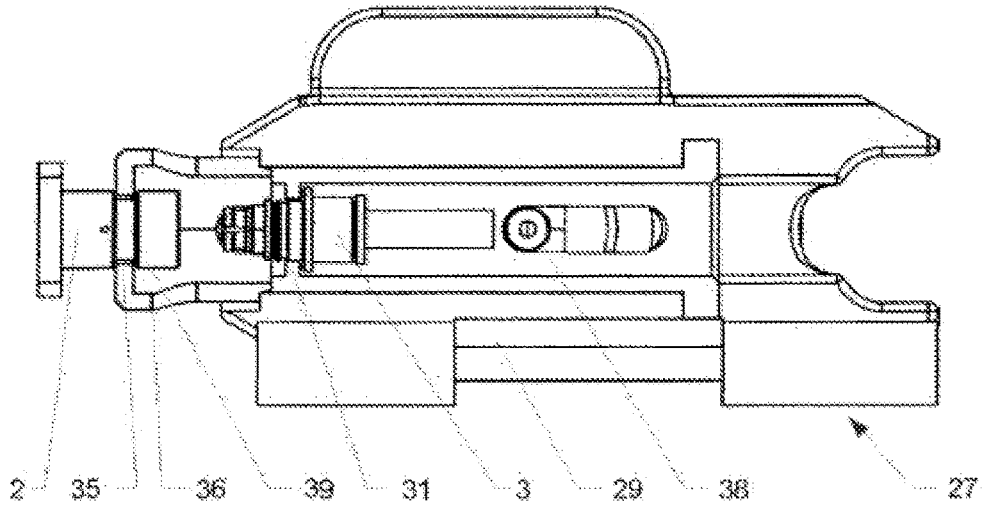
FIG. 12 is the unlocking device 27 according to FIG. 11 in a second position of the displaceable part.

In the third variation of the unlocking device 27, shown in FIG. 11 and FIG. 12, the unlocking device 27 features a displaceable part 36. The displaceable part 36 encompasses at least partly and axially secures the first connector portion 2 through a second rim 35 engaging in an unlocking groove 39 of the first connector portion 2. The displaceable part 36 further comprises an actuator 38 by which a user may move the displaceable part 36 in direction of the connector axis 5. The actuator may be either mechanically or electrically driven. The axial position of the displaceable part 36 in relation to the unlocking device 27 is preferably restricted in the direction of the connector axis and the displaceable part is displaceable between a first and a second position. In this variation, this is achieved by means of a pin 37 being part of the displaceable part 36, moving in a restricted cutaway 40 of the non-displaceable parts of the unlocking device 27. In the shown embodiment the cutaway is located in one of the clamping elements 28, 29. In the first position of the displaceable part 36, the first and the second connector portions 2, 3 are in the connected state; however, the locking ring 4 is radially deformed by the first rim 31 as described above, and thereby the outer and the inner locking shoulders 10, 11 are disengaged. By moving the displaceable part 36 in direction of the connector axis 5, the first connector portion 2 is moved away and from the second connector portion 3 through the engagement of the second rim 35 with the unlocking groove 39. Therefore, during the displacement process the inner locking shoulder 10 is moved over the outer locking shoulder 11. Hence, in the second position, the connector portions 2, 3 are in the fully disconnected state. The two disconnected connector portions 2, 3 can than easily be removed from the unlocking device 27.

It is noted that the use of a locking device is not essential. Other devices or tools may be used as well, provided they are suited to engage the unlocking surface 12 and compress the locking ring 4 as explained before.

The words used in the specification are words of description rather than limitation, and it is understood that various changes may be made without departing from the spirit and scope of the invention.

The invention claimed is:

1. A connector assembly (1) comprising:

a. a first connector portion (2) with a first housing (6) with a circumferential inner locking shoulder (10) at a first end (8) of the first housing (6);

b. a second connector portion (3) interconnectable with the first connector portion (2), having a second housing (7) with a circumferential outer groove (9);

c. a radially deformable locking ring (4) arranged in the circumferential outer groove (9) of the second connector portion (3), the radially deformable locking ring (4) including i. a circumferential outer locking shoulder (11), behind which the inner locking shoulder (10) of the first connector portion (2) is locked in a connected state of the first and the second connector portion (2, 3)

ii. an unlocking surface (12) that is circumferentially accessible from an outer vicinity of the unlocking surface (12) in the connected state, wherein the locking ring (4) is adapted to deform in a radial direction upon application of a radial force, and wherein the outer locking shoulder (11) is located in a direction of connection behind the unlocking surface (12) on the locking ring (4); and iii. an axial slot (13), wherein the axial slot (13) extends over the outer locking shoulder (11) and the unlocking surface (12).

2. The connector assembly (1) according to claim 1, wherein a radial overlap (A1) of the inner locking shoulder and the outer locking shoulder is smaller than a radial displacement of the outer locking shoulder caused by deformation of the locking ring to disconnect the two connector portions.

3. The connector assembly (1) according to claim 1, wherein an isolating element is placed between the locking ring (4) and the second housing (7).

4. The connector assembly (1) according to claim 1, wherein the locking ring (4) has an optical recognizable signalling surface (17) covered entirely by the inner locking shoulder (10) in the connected state.

5. The connector assembly (1) according to claim 1, wherein multiple resilient latches (18) are arranged at a first end (19) of the second housing (7) which latch behind a circumferential inner contact shoulder (20) of the first housing (6) in the connected state.

6. The connector assembly (1) according to claim 1, wherein the first connector portion (2) is a female connector portion.

7. The connector assembly (1) according to claim 1, wherein the connector assembly (1) is a coaxial connector assembly.

8. The connector assembly (1) according to claim 1, wherein the connector assembly (1) comprises an Anti-EMI element (16).

9. The connector assembly (1) according to claim 8, wherein in the connected state the Anti-EMI element (16) is radially arranged between the first and the second housing (6, 7).

10. An unlocking device (27) for unlocking a connector assembly (1) according to claim 1, comprising:

a. at least one clamping element (28, 29) with a recess (30) shaped to receive at least partly the second connector portion (3); and b. a first rim (31) extending in the recess (30), having a diameter (D3) smaller than the diameter (D1) of the inner locking shoulder (10).

11. The unlocking device (27) according to claim 10, wherein the unlocking device (27) further comprises a spreading element which during unlocking exerts an additional axial force to disengage the first and the second connector portion (2, 3).

12. The unlocking device (27) according to claim 11, wherein the spreading element is a displaceable part, which can be displaced in relation to the at least one clamping element (28, 29), and which during unlocking encompasses at least partly an unlocking groove (39) of the second connector portion (3).

13. A method for unlocking the connector assembly (1) as defined in claim 1, comprising the following steps:

a. deforming the locking ring (4) radially inwards so that the diameter (D2) of the outer locking shoulder (11) is smaller or equal than the diameter (D1) of the inner locking shoulder (10);

b. disconnecting the first connector portion (2) and the second connector portion in an axial direction; and c. returning of the locking ring (4) in its non-deformed state.

14. The method according to claim 13, wherein the locking ring (4) is deformed by the unlocking device (27) as defined in claim 10.

* * * * *